United States Patent [19]

Appelt

[11] 4,063,124

[45] Dec. 13, 1977

[54] ROTATING ANODE FOR X-RAY TUBES

[75] Inventor: Güenter Appelt, Erlangen, Germany

[73] Assignee: Siemens Aktiengesellschaft, Berlin & Munich, Germany

[21] Appl. No.: 763,430

[22] Filed: Jan. 28, 1977

[30] Foreign Application Priority Data

Mar. 6, 1976 Germany ..... 2613060

[51] Int. Cl.[2] ..... H01J 35/10

[52] U.S. Cl. ..... 313/60

[58] Field of Search ..... 313/60

[56] References Cited

U.S. PATENT DOCUMENTS 3,710,162 1/1973 Bougle ..... 313/60

*Primary Examiner*—Rudolph V. Rolinec
*Assistant Examiner*—Darwin R. Hostetter
*Attorney, Agent, or Firm*—Hill, Gross, Simpson, Van Santen, Steadman, Chiara & Simpson

[57] ABSTRACT

A rotating anode assembly for an X-ray tube wherein the anode plate is connected with the shaft of the rotor by an axial projection disposed on the rear surface of such plate. The axial projection is shrink-fitted into the end of such shaft.

7 Claims, 2 Drawing Figures

ROTATING ANODE FOR X-RAY TUBES

BACKGROUND OF THE INVENTION

Rotating anodes in X-ray tubes have heretofore been provided with screw-type connections between anode plate and shaft of rotor assembly which requires careful design and manufacturing tolerances. Rotating anode plates have also been connected with rotor assembly shafts by casting or soldering as with copper which results in the achieving of a good thermal connection between shaft and plate, such as a tungsten plate, but unfortunately the melting point of copper is so low that the mounting can become soft as a consequence of the heat generated during tube operation. In addition, the good condition of operationally produced heat leads to undesirable thermal stress and overloading of the shaft bearing most closely disposed to the anode plate. So far as is known, no one has heretofore ever directly interconnected an anode plate to a rotor by means of an axial projection on the anode plate which is shrink-fitted into the end of a tubular therminal shaft associated with the rotor.

BRIEF SUMMARY OF THE INVENTION

More particularly, this invention is directed to an improved rotating anode assembly wherein the anode plate is connected with a tubular terminal shaft portion of a rotor assembly by means of an axial projection on the rear surface of the anode plate which projection is shrink-fitted into the end of such shaft portion.

A primary object of the present invention is to provide an improved rotating anode assembly having simple mounting for a plate on a rotatable shaft.

Another object is to provide a low cost technique for manufacturing a rotatable anode subassembly for an X-ray tube assembly.

Another object is to provide an improved, lower cost X-ray tube of the rotating anode type.

Other and further objects, aims, purposes, features, advantages, applications, embodiments, and the like will be apparent to those skilled in the art from the accompanying specification taken with the drawings.

DETAILED DESCRIPTION

Figure 1:
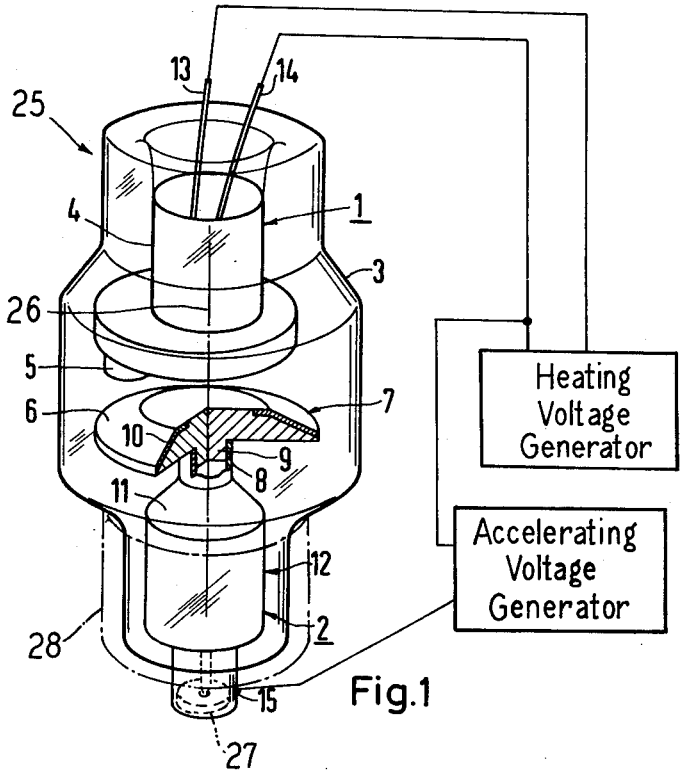
FIG. 1 is a perspective view of an X-ray tube which incorporates one embodiment of a rotating anode assembly of this invention, the anode plate being shown in a partial section.

Referring to FIG. 1, there is seen a rotating anode X-ray tube assembly 25 having a cathode assembly 1 and an anode assembly 2 which are disposed in coaxial relationship relative to one another relative to axis 26 in the evacuated interior of a glass tube 3 on opposed end walls thereof. The cathode subassembly 1 includes a mounting shell 4, which is, in effect, an invested extension of tube 3, and a sleeve 5 in which the actual thermionic cathode (not detailed) is housed, such cathode being hidden by the sleeve 5, but being adapted to emit electrons in an axially parallel direction but in radially spaced relationship to the common axis 26 of cathode assembly 1 and anode subassembly 2. Located in axially spaced but opposed relationship to the forward end of sleeve 5 is a radially, peripherally located, tapered, or inclined, surface 6 on disc-shaped plate 7 in anode subassembly 2 whereon a focal spot path is defined as plate 7 rotates during tube assembly 25 operation. This focal spot path can have, for example, a diameter of about 100 mm. The anode plate 7 is axially mounted at the forward end of a tubular shaft 8 by means of an axial projection 9 on the rear surface of plate 7. For this purpose, the axial projection 9 is sized (preferably cylindrically) so as to be shrink-fittable into the forward end of the tubular shaft 8. The axial projection 9 is here preferably formed integrally with the body of anode plate 7, such body here being comprised of a metal like molybdenum. The axial projection 9 is here, for example, 8 mm long and 15.5 mm in diameter, with a tolerance of between + 0.034 mm and + 0.023 mm (DIN-tolerance r6). Correspondingly, the tubular shaft 8 has an inside- diameter of 15.5 mm with a tolerance of up to ± 0.018 mm (DIN-tolerance H7), here consists of TZM, and has a radial wall thickness of 1.24 mm. TZM designates an alloy having a composition consisting on a 100 weight percent total basis of 0.5 weight percent titanium, 0.07 weight percent zirconium with the balance up to 100 weight percent being molybdenum. The inclined surface 6 of plate 7, which surface 6 is located opposite the forward end of sleeve 5, is provided with a coating or layer 10 here, for example, about 1 mm in thickness, which is comprised of a tungsten alloy containing, on a 100 weight percent basis, preferably about 5 weight percent rhenium. Tubular shaft 8 is mounted and constructed as an axial extension on the upper or forward axial end region 11 of a rotor subassembly 12. Shaft 8 can be comprised of a metal material similar to that used for fabricating the body of plate 7.

For purposes of operation, a heating voltage is connected in a conventional fashion across the cathode in sleeve 5 in the tube assembly 25 by means of leads 13 and 14, and, moreover, an accelerating potential for the electrons which are emitted from the thermionic cathode in sleeve 5 is additionally provided between lead 14 and an anode connecting piece 15. In this manner, the desired acceleration of electrons against on the focal spot path on surface 6 is obtained. There, a conversion of electron radiation into X-ray radiation from layer 10 proceeds in a conventional fashion. As those skilled in the art appreciate, the angle of taper for surface 6 is chosen so as to produce a desired X-ray emission angle and pattern; see, for example, pages 102–104 of the work. "The Fundamentals of Radiological Science".

The rotor sub-assembly 12 has cylindrical side walls and incorporates internally therewithin means responsive to a circumferentially applied electromagnetic force. Such force can be supplied by a stator 28 mounted circumferentially about cylindrical side wall portions of the rotor sub-assembly 12 with the wall portions of the tube 3 intervening therebetween. Such a force; as from stator 28, causes the rotor sub-assembly 12 to rotate about axis 26 during operation of the tube 25. The internal structure of rotor sub-assembly 12 is hidden by its wall portions, as shown.

The rotor sub-assembly 12 is provided with a bearing 27 which adapts the rotor sub-assembly 12 for such rotational movements about axis 26. The bearing 27 includes contact portions, here illustrated by anode connecting piece 15, for applying to the rotor subassembly 12 during such rotational movements thereof a desired electron accelerating potential.

Further, constructional details for tube assembly 25 are illustrated, for example, by Seifert et al U.S. Pat. No. 3,878,395 issued Apr. 15, 1975.

When the invention is practiced with graphite anodes, the body of plate 7 is fabricated with graphite instead of molybdenum. Layer 10 may, in a conventional fashion, be composed of a metal, such as tungsten or a rhenium-tungsten alloy, or of some other high melting conductive material.

Figure 2:
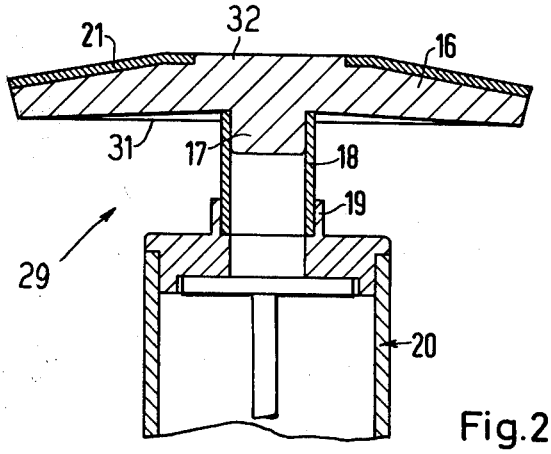
FIG. 2 is a fragmentary view in axial section of another embodiment of a rotating anode assembly of this invention.

In FIG. 2 there is seen a portion of another embodiment of a rotating anode assembly designated in its entirety by the numeral 29 in which a radially ribbed rear face 31 is provided in an anode plate 16. Face 31 of plate 16 has an axial projection 17 whose circumferential walls are sized so as to be shrink fit into the forward end of a tubular shaft 18. Shaft 18 is here constructed as a tubular section whose rear end, which is remote from plate 16, is itself shrink fitted within an axial tubular extension or collar 19 of a rotor assembly 20. Plate 16, like plate 7 of tube assembly 25, is provided on its front face 32 with a coating or layer 21 in the region of the focal point path, the layer 21 being similar to layer 10 in construction. These shrink-fit connections are disposed one within the other in such a manner that the heat flow from plate 16 flows from an interior section which is to be supported into a supporting member, for example, from the shaft 18 to the supporting tubular extension 19 of the rotor assembly 20.

Shrink fitting connections, such as those between shaft 8 and axial projection 9 (FIG. 1), or of axial projection 17 and shaft 18, and shaft 18 and extension 19 (FIG. 2), may be accomplished by processes which are known to the prior art. In the selection of materials and dimensions, such as for tube assembly 25, shaft 8 is, for example, heated to about 800° to 1000° C, and slipped over journal 9 which is conveniently at room temperature. Subsequently, the resulting assembly is cooled to room temperature. In the subsequent heating of this assembly as incorporated into tube 25 during operation of the anode subassembly 2, the heating always proceeds from the anode plate 7 as a consequence of the heat flow through axial projection 9 into shaft 8, or with regard to tube assembly 26, from shaft 18 into extension 19. The shrink-fitting operations are thus accomplished and arranged so that permanent, tight connections are obtained through shrink-fitting which take account of the manner in which heating proceeds.

By way of variation, a shrink-fitting may also proceed in such a manner that the axial projections 9 or 17 are each first cooled to a great extent and then inserted into the (room temperature) tubular shaft 8 or 18. During subsequent heating to room temperature, the desired fastening proceeds as a result of the expansion of the projections 9 or 17. In order to effect cooling, a liquified gas, such as liquid air or liquid nitrogen, can be used. This method has been proven to be especially favorable, and is simple, because it is possible to proceed with a mere dipping of the entire anode plate 7 or 16 into the liquid gas followed by such a subsequent insertion. A combination of both processes (heating of the shafts 8 or 18 and cooling of the projections 9 or 17) can also render possible a simplification and simultaneous adaptation of the invention to the materials employed.

In a rotating anode constructed in accordance with the teachings of this invention, a precise and lasting connection is obtained rapidly, in a clean and simple fashion, and with certainty, due to the fact that an axial projection from the anode plate is connected with an anode rotor assembly through a shrink-fitting by means of a linking tube section which has been worked into a press or force fit. The invention avoids the afore mentioned difficulty occuring in connection with the use of a solder-type connection, this difficulty consisting in that a solder-type connection becomes soft as a consequence of the heating occurring during tube operation and causes a tendency to produce an unbalanced mass. Also, the invention makes it possible to avoid the tolerances necessary in the type of screwed connections between anode plate and rotor shaft which are commonly conventionally used commercially today. Such tolerances are necessary because of the technology employed in manufacture of such components, particularly in the windings and in the drivers in order to ensure the desired rotational movement. Thus, it is possible by this invention to dispense with a subsequent balancing compensation manufacturing operation. In the case of graphite anodes, it is precisely such a processing i.e., a wearing off of material, which results in a harmful generation of loose particles. Because of the rigid, and, consequently, abrasion-free support mounting employed in the present invention, a further basis for loose particles is eliminated. Moreover, a clamping-type mounting, such as is provided by the present invention, is well suited for the physical properties of graphite. The support mounting of a rotating anode plate achieved by the present invention has proven to be particularly advantageous and expedient when graphite is used as a material for rotating anode plate construction.

Preferably, the materials used for the axial projection employed in this invention on the rear surface of the anode plate are the same materials as those employed in the body of the plate itself. Especially in the case of the so-called composite plates having an incorporated layer 6 or 21, the plate body is preferably molybdenum or molybdenum alloys with high melting metals, such as tungsten, rhenium, zirconium, or metals with a similarly high melting point and low vapor pressure.

The body of an anode and of an axial projection may also be composed of graphite, or the like, if such a constructional material satisfies the aforementioned requirements. As in the case of metal anodes, the plate and the axial projection can be produced as parts, and then combined, or more preferably, they are manufactured out of a single piece of material.

When molybdenum or a molybdenum alloy, or graphite, is used for the axial projection, the tubular extension on the rotor assembly may preferably consist of a TZM alloy. Given a dimension of about 15.5 mm diameter of the axial projection, and a wall thickness of about 1.25 mm for the tubular extension, and a length for the axial projection of about 8 mm, the dimensional tolerances, that is, the outer diameter of the axial projection relative the inner diameter of the extension tubes, should preferably lie, for the axial projection diameter, at room temperature, between about 0 and 35 microns thicker than the inside diameter of the extension tube, in order that a sufficient and desirable compacting pressure-connection may be obtained during and as a result of the shrink-fitting process. In addition to a suitable selection of the respective component dimensions at room temperature, it is preferred that the thermal coefficient of expansion of the outermost component (such as the extension tube relative to the axial projection) be smaller than that of the innermost component. Moreover, depending upon the selection of construction materials, a type of pressure welding between contacting components is commonly obtained during shrink-fitting as a result of the pressures inherently occurring. The axial projection and the extension tube are thereby so securely interconnected to one another that they can no longer be separated from one another during a subsequent heating. A tight connection of this type occurs, for example when employing as a plate material molybdenum, and as an extension tube material, TZM.

In using a tubular section as taught herein to connect a plate with a rotor, a hollow shaft having a small wall radial thickness, and thus a desirably low thermal conductivity is employed, preferably. The thermal load or stress on the pivot bearing of the anode assembly is thereby also reduced, because the heat is not so much conducted through the shaft, but, instead, is radiated from a plate.

For the extension tube used for connecting a plate with a rotor, it is also possible to employ materials other than TZM as long as such manifest similar toughness properties and similar thermal behaviour, including high melting point. It is only preferred to exercise the precaution that expansion of the materials lies in such a range that a minimum shrinkage diameter of several microns is achieved during the high temperatures occuring in tube manufacture and also in assembled tube operation. According to present experience, about 5 microns minimum shrinkage is sufficient and desirable, so that preferably the axial projection has a diameter of from 5 to 35 microns greater than the inside diameter of the tubular shaft configuration.

As a rule, the tubular shaft, or extension tube, is directly and preferably produced as an axial extension of the rotor assembly during manufacture of the rotor assembly. However, constructions are also expedient in which the rotor assembly itself has an additional axial tubular extension or collar which is shrink-fitted about a lower end portion of the tubular shaft (or extension tube). The collar extension attachment on the rotor assembly may be fabricated from materials similar to those of the axial projection and the tubular shaft. Expediently, a tungsten-zirconium-molybdenum alloy is used, for example, in order that expansion properties may be obtained which guarantee a temperature-resistant-connection. However, the attachment may, for example, also be composed of a iron nickel cobalt alloy like Vacon, being an alloy of 28% nickel 15 to 25% cobalt and a balance up to 100% being iron or Kavar containing 29% nickel, 17% cobalt and iron up to 100% (all % are weight %). Other suitable materials are molybdenum, and its alloys, preferably a molybdenum-nickel-alloy, or the like.

In order to achieve the above indicated heat dissipation characteristics, and still obtain a product rotating anode assembly as taught by this invention, it is desirable to have the tubular shaft of the rotor means in the region where such is shrink fitted about the axial projection have an inside diameter ranging from about 2 to 0.8 times the axial length of such axial projection. Preferably, the axial projection has an axial length ranging from 0.5 to 4 centimeters (more preferably from about 1 to 2 centimeters).

Other and further embodiments of the present invention will be apparent to those skilled in the art from the preceding description.

I claim:

1. In an improved rotating anode assembly for an X-ray tube such rotating anode assembly being one of the type which includes an anode plate member and a cylindrical rotor means therefor, such rotor means having (a) an axis, (b) means responsive to circumferentially applied electromagnetic force causing said rotor means to rotate about such axis, and (c) bearing means functionally associated therewith and adapting said rotor means for rotational movements relative to said bearing means, said bearing means including contact portions for applying during such rotational movements an electron accelerating potential to said plate member, the improvement which comprises the combination of A. a shaft axially extending from one end of said rotor means and terminating forwardly in a tubular configuration, said shaft being rotationally associated with said rotor means and rotatable therewith, B. said plate member having a generally disc-shaped body and being coaxial with said axis, said plate member having radially tapered surface portions on one face thereof adjacent the circumferential periphery of said plate member, said surface portions being adapted to convert incident electron energy striking same in an axially parallel direction into X-ray energy emitted therefrom at a predetermined angle relative to said incident electron energy, and further having an axial projection extending from the opposed face thereof, C. said tubular configuration having an inside diameter ranging from about 2 to 0.8 times the axial length of said axial projection, D. said axial projection being shrink fitted into said tubular configuration.

2. The anode assembly of claim 1 wherein at room temperature said axial projection is cylindrical and integral with said body and diameter ranging from 0 to about 35 microns greater than the inside diameter of said tubular configuration.

3. The anode assembly of claim 1 wherein at room temperature said axial projection has an axial length ranging from about 0.5 to 4 centimeters.

4. The anode assembly of claim 2 wherein said axial projection diameter ranges from about 5 to 35 microns.

5. The anode assembly of claim 1 wherein said shaft is tubular and rearwardly is shrink fitted into a coaxially located collar on said rotor means.

6. The anode assembly of claim 1 wherein said body and said shaft are comprised of a metal selected from the group consisting of molybdenum and molybdenum alloys with high meltable metal.

7. The anode assembly of claim 6 wherein said metal is a molybdenum alloy comprised on a total weight basis of 0.5% titanium, 0.07 weight percent zirconium, with the remainder up to 100 weight percent being molybdenum.

* * * * *